US008276512B2

(12) United States Patent
Pasuch et al.

(10) Patent No.: US 8,276,512 B2
(45) Date of Patent: Oct. 2, 2012

(54) PROCESS AND APPARATUS FOR TREATING AN IMAGED PRINTING FORM, RE-IMAGEABLE PRINTING FORM AND MACHINE FOR PROCESSING PRINTING MATERIAL

(75) Inventors: Michael Pasuch, Walldorf (DE); Helge Grandt, Sandhausen (DE); Matthias Schlörholz, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 790 days.

(21) Appl. No.: 11/958,884

(22) Filed: Dec. 18, 2007

(65) Prior Publication Data

US 2008/0152798 A1 Jun. 26, 2008

(30) Foreign Application Priority Data

Dec. 20, 2006 (DE) ..... 10 2006 060 290 n

(51) Int. Cl.
*B41N 3/08* (2006.01)
*B41N 1/16* (2006.01)
*B41M 1/06* (2006.01)

(52) U.S. Cl. ..... 101/463.1; 101/465; 101/450.1; 101/453

(58) Field of Classification Search ..... None
See application file for complete search history.

(56) References Cited

U.S. PATENT DOCUMENTS

| | | | | |
|---|---|---|---|---|
| 718,340 | A | 1/1903 | Graul et al. | |
| 4,718,340 | A * | 1/1988 | Love, III | 101/116 |
| 5,170,706 | A | 12/1992 | Rodi et al. | |
| 6,851,366 | B2 | 2/2005 | Gutfleisch et al. | |
| 2002/0096074 | A1 | 7/2002 | Hartmann et al. | |

FOREIGN PATENT DOCUMENTS

| | | | |
|---|---|---|---|
| DE | 4013464 | A1 | 10/1991 |
| DE | 10227054 | A1 | 12/2003 |
| DE | 10345388 | A1 | 4/2005 |

* cited by examiner

*Primary Examiner* — Joshua D Zimmerman
(74) *Attorney, Agent, or Firm* — Laurence A. Greenberg; Werner H. Stemer; Ralph E. Locher

(57) ABSTRACT

A process for treating an imaged printing form, in particular a printing form covered with amphiphilic molecules or with polymers, such as saccharides, includes applying a gum, in particular a microscopic gum layer, to the surface of the printing form in the liquid state. The gum is removed or reduced down to a remaining nanoscopic covering after a short or negligible time interval, relative to the time interval until the application of lithographic liquid, for example dampening solution or printing ink, to the surface. The removal or reduction of the gum is preferably carried out in the still liquid state, i.e. before the applied gum dries on, and preferably immediately after the application. The remaining gum covering protects the printing form against contaminants and increases its hydrophily/hydrophoby contrast. An apparatus for treating an imaged printing form, a re-imageable printing form and a machine for processing printing material, are also provided.

6 Claims, 2 Drawing Sheets

Figure 1:
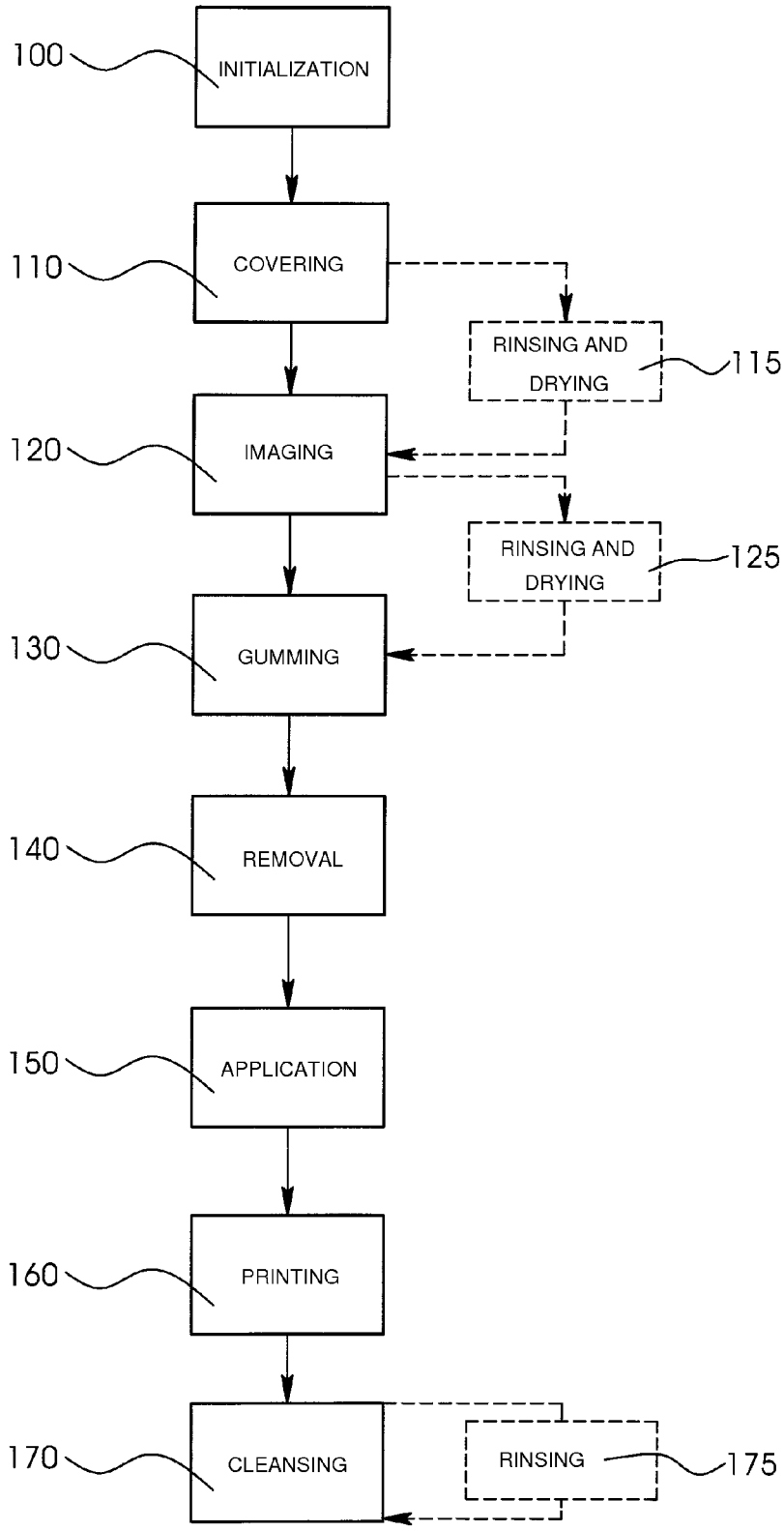

PROCESS AND APPARATUS FOR TREATING AN IMAGED PRINTING FORM, RE-IMAGEABLE PRINTING FORM AND MACHINE FOR PROCESSING PRINTING MATERIAL

CROSS-REFERENCE TO RELATED APPLICATION

This application claims the priority, under 35 U.S.C. §119, of German Patent Application DE 10 2006 060 290.0, filed Dec. 20, 2006; the prior application is herewith incorporated by reference in its entirety.

BACKGROUND OF THE INVENTION

Field of the Invention

The present invention relates to a process for treating an imaged printing form, in which a gum is applied to a surface of the printing form in the liquid state. Furthermore, the present invention relates to a re-imageable printing form having a surface structured by imaging and a nanoscopic covering rendering the surface chemically functional in imaged regions with amphiphilic molecules or with polymers, in particular saccharides. In addition, the present invention relates to an apparatus for treating an imaged printing form by using a roll which, in the function of an applicator roll, applies gum in the liquid state to the surface of the printing form. The present invention also relates to a machine for processing printing material, in particular a printing press or sheet-processing rotary press for lithographic offset printing.

Generic processes, printing forms and apparatuses are used in the area of the imaging/re-imaging and treatment of imaged/re-imaged printing forms, in particular in printing units of a machine for processing printing material sheets, for example a lithographic offset press for processing paper or board sheets.

Printing plates covered nanoscopically with amphiphilic molecules, which are known from the prior art, for example from German Published, Non-Prosecuted Patent Application DE 102 27 054 A1, corresponding to U.S. Pat. No. 6,851,366, can be imaged repeatedly and thus reused in a circular process. A printing form having a hydrophilic printing area, for example of a natively oxidized titanium, is disclosed, and the printing area is covered with an amphiphilic compound that bonds strongly to the surface. The printing form can be imaged point by point by using an infrared laser. To that end, the externally hydrophobically acting cover in non-imaged regions is removed or desorbed by using laser radiation and, in the process, hydrophilic surface regions are created. It is also known to cover printing forms imaged in such a way with gum following imaging, through application of a gum layer. Following the printing and before the re-covering and re-imaging, a cleaning of the surface and, if appropriate, initialization is necessary, since residues of the gum layer can make the re-covering with amphiphilic compounds more difficult.

German Published, Non-Prosecuted Patent Application DE 103 45 388 A1 describes a method and a composition for the gumming of lithographic printing plates. The printing plate is subjected to gumming in order to protect the substrate, for example an aluminum substrate, exposed in accordance with an image during imaging, against oxidation, fingerprints and so on. The gum described, which is applied to the printing plate, for example with a squeegee roll and immediately after the imaging, protects the printing plate during storage and relatively long stoppage of the press without ink acceptance problems and/or poor free-running behavior occurring during printing. The pH of the gumming solution is more than 7 and the gum thickness is generally 3 μm.

The manufacturers of such gums, for example Eggen Chemie in the case of Agum Z, stipulate that the gum applied must be dried directly after application, for example by using hot air blowers. Such drying is carried out, for example, in the Polychrom 85 plate developer from Kodak. The dried gum layer is removed again before printing from the printing form.

German Published, Non-Prosecuted Patent Application DE 40 13 464 A1, corresponding to U.S. Pat. No. 5,170,706, describes the automatic gumming of a printing form of a press, in which a gumming liquid is applied to the printing form through the use of a gumming device by a dampening solution applicator roll and, if appropriate, a distributor cylinder. For the purpose of automatic removal of the gum, the printing form and, at the same time, the dampening solution applicator roll and the distributor cylinder, are washed through the use of washing apparatus.

SUMMARY OF THE INVENTION

It is accordingly an object of the invention to provide a process for treating an imaged printing form, which overcomes at least one of the hereinafore-mentioned disadvantages of the heretofore-known processes of this general type.

It is a further or alternative object of the present invention to provide a process for the treatment of an imaged printing form that is improved as compared with the prior art. According to this process, the removal of a gum is carried out in such a way that simple and frequent reuse of the printing form is made possible.

It is a further or alternative object of the present invention to provide a process for the treatment of an imaged printing form that is also improved as compared with the prior art. According to this process, the removal of a gum is carried out in such a way that simple and frequent reuse of the printing form through the use of re-covering and re-imaging is made possible.

It is a further or alternative object of the present invention to provide a process for the treatment of an imaged printing form that is additionally improved as compared with the prior art. According to this process, the removal of a gum is carried out in such a way that printing from the printing form with little start-up wastage is made possible.

It is a further or alternative object of the present invention to provide a re-imageable printing form that is improved as compared with the prior art, in which the printing form can be reused, in particular re-covered and re-imaged, in a simple way and frequently.

It is a further or alternative object of the present invention to provide an apparatus for the treatment of an imaged printing form that is improved as compared with the prior art, and which apparatus permits gumming of the printing form in a simple way to produce a gum covering.

With the foregoing and other objects in view there is provided, in accordance with the invention, a process for treating an imaged printing form. The process comprises applying a gum in a liquid state to a surface of the printing form, and removing or reducing the gum down to a covering after a time interval being short relative to a time interval until an application of lithographic liquid to the surface.

According to a first alternative of the invention, the gum is removed or reduced again shortly after the application. The gum layer applied is removed but a remaining nanoscopic gum covering is not. However, the remaining covering is advantageously sufficient for the further treatment of the printing form. It protects the imaged surface of the printing form adequately against contaminants and adequately improves the contrast between imaged and non-imaged regions. The start-up wastage is reduced sharply by the reduction of the gum to a covering and the reusability is likewise improved because of an improved ability to be re-covered with amphiphilic molecules.

With the objects of the invention in view, there is also provided a process for treating an imaged printing form. The process comprises applying a gum in a liquid state to a surface of the printing form, and reducing or removing the gum while still in the liquid state down to a covering.

According to a second alternative of the invention, the gum is removed or reduced down to a remaining nano-scale gum covering in the still liquid state, which is to say even before it dries on. The result is the same advantages as described above in relation to the first alternative.

In accordance with another mode of the invention, that is advantageous with regard to the reduction of start-up wastage and the ability to be re-covered with amphiphilic molecules and is therefore preferred, the gum is removed or reduced immediately after the application. In this connection, "immediately" can mean that the time interval between application and removal/reduction is negligible as compared with the total time interval of the preparation of the reusable printing form for a new print job and, for example, does not need to be taken into account when calculating the set-up time.

In accordance with a further mode of the invention, that is advantageous with regard to the simple and chemically unproblematic removal of gum and is therefore preferred, the gum is removed by rinsing with deionized water.

In accordance with an added mode of the invention, that is simple with regard to the measures used and therefore advantageous and preferred, the gum is applied by using an applicator roll set against the surface of the printing form.

In accordance with an additional mode of the invention, that is advantageous with regard to simple drying carried out with few measures employed and is therefore preferred, the gum is dried by having the applicator roll roll over it.

With the objects of the invention in view, there is furthermore provided a re-imageable printing form, comprising a surface structured by imaging, a nanoscopic covering rendering the surface chemically functional in imaged regions with amphiphilic molecules or with polymers, in particular saccharides, and a nanoscopic covering with a gum in non-imaged regions.

As opposed to printing forms of the prior art, the printing form according to the invention does not have a gum layer that is micrometers thick but a gum covering that is only nanometers thick, yet protects the printing form adequately and advantageously leads to less start-up wastage and to an improved ability to be re-covered with amphiphilic molecules.

In accordance with another feature of the invention, that is advantageous with regard to the low thickness (or low strength) of the covering and is therefore preferred, a covering has a gum of less than about 100 nm, in particular of less than about 10 nm, in thickness.

With the objects of the invention in view, there is additionally provided an apparatus for treating an imaged printing form. The apparatus comprises a roll functioning as an applicator roll for applying gum in a liquid state to a surface of the printing form. The roll functions as a cleaning roll for reducing or removing the gum down to a covering after a time interval being short relative to a time interval until an application of lithographic liquid to the surface.

An apparatus according to the invention includes a roll that can be and is used multifunctionally, which is used both to apply and also to remove or reduce the gum. The apparatus can include a control system, which switches off the supply of gum after sufficient application and continues to leave the roll set against the printing form for a predefined time interval, so that removal/reduction of the gum is carried out through the roll.

When the apparatus according to the invention is used, the result is the same advantages as have already been described above with reference to the process according to the invention.

With the objects of the invention in view, there is concomitantly provided a machine for processing printing material, in particular a printing press or a sheet-processing rotary printing press for lithographic offset printing. The printing press comprises at least one apparatus as described above with reference to the invention.

The machine for processing printing material is preferably a sheet-processing rotary printing press for lithographic offset printing, in particular wet offset printing. The printing material can be board, film or preferably paper. The printing press can be operated in the recto printing mode or preferably in the perfecting mode. The printing press can provide the printing material with single-color or preferably with multicolored printed images. The printing press can have a feeder, a feed table, a plurality of printing units, a turning device, further printing units, a varnishing unit, a dryer, a powdering apparatus and/or a delivery, as seen in the printing material transport direction. The printing press can include an operating desk and a control unit.

Provision can also be made for the imaging and the application of a gum to be carried out in separate machines.

The invention described and the advantageous developments of the invention that are described also constitute advantageous developments of the invention in any desired combination with one another.

The invention and further structurally and functionally advantageous developments of the invention will be described in more detail below with reference to the associated drawings and by using at least one preferred exemplary embodiment.

Other features which are considered as characteristic for the invention are set forth in the appended claims.

Although the invention is illustrated and described herein as embodied in a process and an apparatus for treating an imaged printing form, a re-imageable printing form and a machine for processing printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF DRAWING

Figure 2:
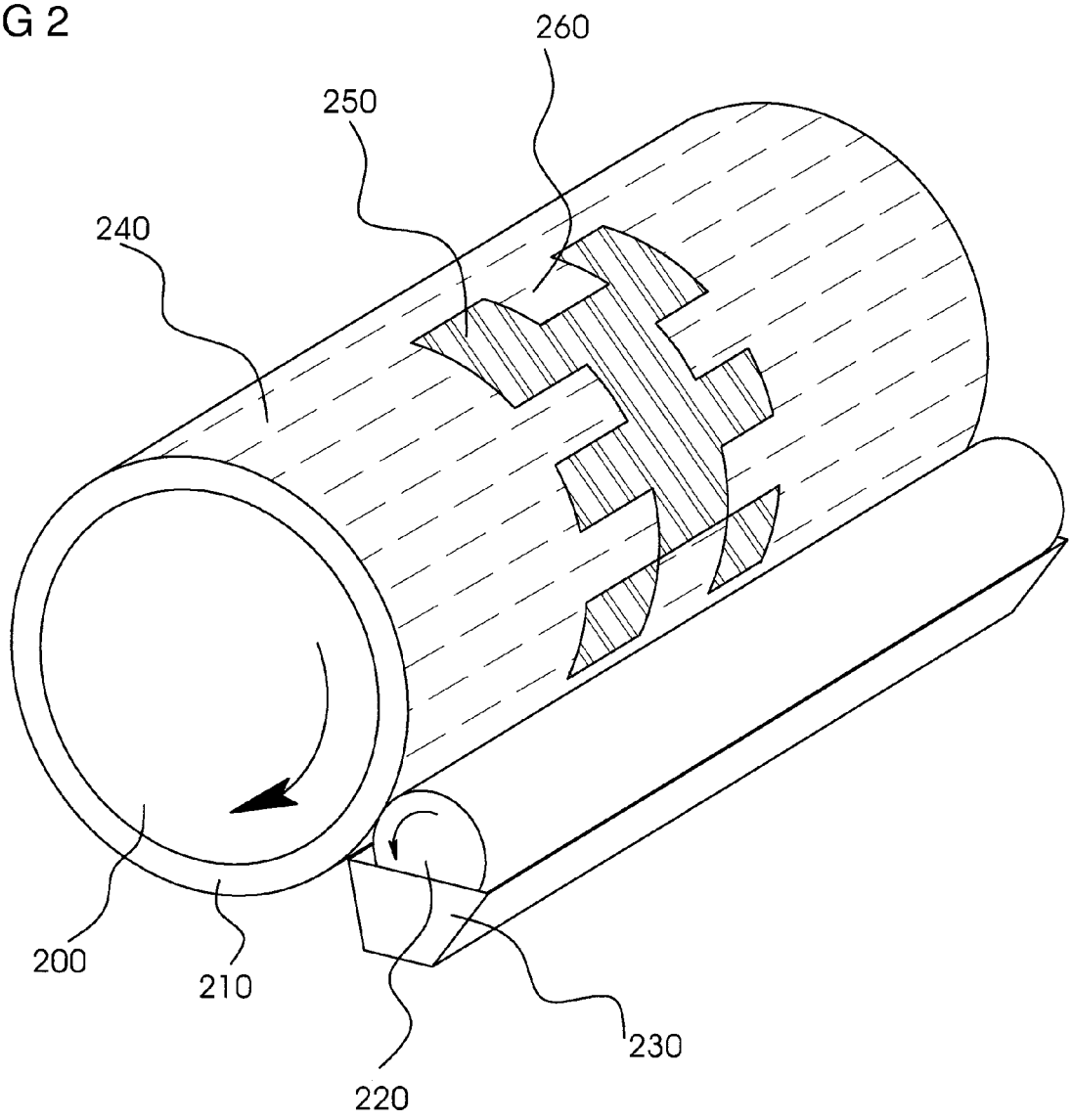

FIG. 1 is a flow chart of a preferred exemplary embodiment of a process according to the invention; and FIG. 2 is a diagrammatic, perspective view of a preferred exemplary embodiment of an apparatus according to the invention and a printing form according to the invention.

DETAILED DESCRIPTION OF THE INVENTION

Referring now to the figures of the drawings in detail and first, particularly, to FIG. 1 thereof, there is seen a flow chart of a preferred embodiment of a process according to the invention for the treatment of an imaged printing form. Such a printing form can include titanium dioxide, for example, or be formed from titanium dioxide and disposed on a substrate, for example of metal or plastic. The printing form is preferably constructed as a printing plate for lithographic offset printing. The process according to the invention can be carried out both in a machine processing printing material, in particular in a printing press, as well as, at least partly outside such a machine, which is to say in the case of at least some process steps such as the initialization, the covering, the imaging, the gumming and/or the removal.

In a process step 100 (initialization), a roughly and optionally finely cleaned surface (see process step 170 below) is initialized before a renewed covering in a process step 110 with molecules, by carrying out a treatment, preferably wiping, of the surface by applying an initialization liquid, in particular water, deionized water or an aqueous initialization solution. A treatment is preferably carried out with an aqueous solution of a double salt having an alum structure and particularly preferably with an aqueous, for example 0.1 molar, potassium aluminum sulfate solution (alum solution, $KAl(SO_4)_2 \cdot 12H_2O$). Through the use of the initialization, the surface is prepared for the covering with molecules, in particular for the homogenous hydrophobicization of the surface, so that a dense covering, which is to say a high level of coverage with the molecules, can be achieved. The surface of the printing form then has sufficiently many activated docking points for the molecules. A removal of the developer that is sufficient for a renewed homogenous covering is normally not ensured merely through the use of the rough cleaning and the fine cleaning.

In the process step 110 (covering), the surface of the printing form is surface-modified in the nanoscopic range, by carrying out chemical functionalization of the surface through the use of a treatment, preferably by wiping the surface, with molecules, in particular by covering with molecules. The molecules are preferably dissolved (e.g. in water) and the solution is either applied directly to the surface or indirectly to the surface by a cloth, for example sprayed. The molecules used for the covering are preferably amphiphilic molecules, for example phosphoric acid or hydroxamic acid in aqueous solution. Alternatively, it is also possible for polymers, in particular saccharides, to be used. The covering effects a nanoscopic change to the surface, which is to say a change in the range below 100 nm or particularly preferably below 10 nm. It is possible to use both molecules that bond strongly to the surface and molecules that bond weakly. When molecules that bond weakly are used, they are preferably fixed to the surface by using infrared radiation. In an optional process step 115 (rinsing and drying), the surface is rinsed, preferably with deionized water, and then dried. The rinsing liquid is either applied directly to the surface or indirectly to the surface, for example by a cloth. In a process step 120 (imaging), the covered surface is imaged and structured into imaged regions and non-imaged regions. To this end, the surface is preferably treated by using an infrared laser or radiation from the latter. When strongly bonding molecules are used, they are removed by the laser radiation in non-imaged regions (regions carrying dampening solution). When weakly bonding molecules are used, they are fixed by the laser radiation in the imaged regions (regions carrying printing ink) and removed in non-imaged regions (regions carrying dampening solution). In an optional process step 125 (rinsing and drying), rinsing and drying are carried out in accordance with the process step 115 mentioned above.

In a process step 130 (gumming), gum in the liquid state, preferably a solution of gum arabic or another gum solution, is applied to the entire imaged surface of the printing form or the surface is gummed. Through the use of the gumming, the contrast between imaged regions and non-imaged regions is improved as a result of intensification of the hydrophilic character in the non-imaged regions and, at the same time, the surface is protected, for example against fingerprints (this is because the medium is also intended to be understood as "gumming" in this sense in this application). The gum is either applied directly to the surface or indirectly to the surface, for example by a cloth.

For example, the printing form is provided once or preferably many times with undiluted gum solution (e.g. Agum Z from Eggen-Chemie) by an applicator roll set against it under pressure, with between about 0.9 and 1.0 $g/m^2$ of gum being applied. Directly following this, the removal of the gum down to a covering is carried out by rinsing with deionized water. The amount in $g/m^2$ of the remaining gum covering is negligible as compared with the amount applied. Once more directly following this, the applicator roll is caused to roll over the surface under pressure, preferably many times, without the addition of process liquids, and thus drying is carried out.

In a process step 140 (removal), the gum is removed again down to a covering after a short time interval, preferably a few seconds up to a few minutes, for example after at most 2 minutes, relative to the time interval until the application of lithographic liquid, for example dampening solution and/or printing ink, to the surface (see process step 150 below). This means that: while in the prior art the gum is not removed in the intermediately dried and hardened state until shortly before the application or during the application of lithographic liquid, which is to say hours after the gumming in the case of printing plate storage, through the use of a separate washing apparatus or by the dampening unit, according to the invention the removal is already carried out shortly after the gumming. The time interval between application and removal of the gum is therefore preferably shorter than the time interval between removal and application of lithographic liquid.

Preferably (or else alternatively), the gum is removed down to a covering again in the still liquid and/or undried state, which is to say even before it has dried. Particularly preferably, the gum is removed down to a remaining covering again immediately after the application of the gum.

In the process step 140, the thickness of the gum layer applied is reduced, preferably to a nanoscopic dimension, so that the gum which has been applied and remains on the surface can also be considered a nanoscopic covering. Such a gum covering can be present as a monolayer. However, it is also possible for there to be a plurality of layers on the surface.

If the application and the removal of the gum are considered as a single process, then it is not a layer in the micrometer range which is applied but a covering in the nanometer range that is produced. However, it has surprisingly been found that a gum covering improves the contrast of the imaged surface of the printing form sufficiently and protects the imaged surface adequately. Furthermore, it has been found that, in the case of a printing form having a gum covering according to the invention, the ink acceptance and the carrying of dampening solution stabilize very quickly in an advantageous way, which is to say as early as after two to three printing material sheets of start-up wastage. In this case, the storage capability of printing forms having a gum covering according to the invention is advantageously comparable with printing forms coated conventionally with gum. Therefore, according to the invention, it is possible to dispense with a gum layer that is micrometers thick. The gum covering according to the invention, which is only nanometers thick, can in addition substantially be removed without residue in the initialization process step and therefore has no substantial influence on the re-covering ability.

In a process step 150 (application), at least one lithographic liquid, for example dampening solution and/or printing ink, is applied to the imaged and gummed surface. Preferably, dampening solution is applied first and then additionally printing ink is applied to the surface, which is to say the surface is dampened and inked. If weakly bonding amphiphilic molecules are used, they can be removed in the non-imaged regions by the application of dampening solution.

In a process step 160 (printing), the inked surface is preferably repeatedly printed off onto printing material and, as a result, at least one printed product is produced.

In the process step 170 (cleaning), the surface is treated, in which rough cleaning for the removal of ink and/or dirt is carried out (for example by using micro-emulsion cleaner or conventional ink cleaner, such as Printclean). In an optional process step 175 (rinsing and drying), rinsing and drying are carried out in accordance with the process step 115 (see above). After that, the roughly cleaned surface is treated by using isopropyl alcohol, for example, or preferably a surfactant, in which fine cleaning for the removal of ink and/or dirt residues and the removal of possible chemical residues following the rough cleaning takes place. In the optional process step 175 (rinsing and drying), renewed rinsing and drying are carried out in accordance with the process step 115 (see above).

Within the context of the invention, the process steps during which media are applied and/or taken off can be carried out many times, for example by rotating a cylinder which carries the printing surface appropriately often: that is rough and fine cleaning (for example in each case up to 4 times directly after each other), rinsing/drying (for example in each case up to 4 times directly after each other), initialization (for example up to 4 times directly after each other), covering (for example in each case up to 6 times directly after each other) and gumming (for example in each case up to 6 times directly after each other).

FIG. 2 illustrates a preferred embodiment of the apparatus according to the invention. The figure shows a cylinder 200 as part of a machine for processing printing material, having a printing form 210 which is disposed on its surface and which has already been imaged (represented as an imaged region 250), as well as a roll 220 which applies a gum stored in a trough 230 to a surface 240 of the printing form 210 (illustrated as a non-imaged region 260) and, in a second mode, removes/reduces it again down to a covering. It should be noted herein that both the imaged regions 250 illustrated by double lines, as well as the non-imaged regions 260 illustrated in broken lines, cannot readily be detected by the eye on the real printing form. Alternatively, instead of the roll, a cloth treatment device for the application and removal/reduction of the gum is possible, for example a cloth guided over two rollers.

The invention claimed is:

1. A process for treating an imaged printing form, the process comprising the following steps in order:

applying a gum solution to the printing form by using an applicator roll;

removing the gum down to a covering by rinsing with water; and drying the printing form by rolling the same applicator roll under pressure on the surface of the printing form to squeeze out water.

2. The process according to claim 1, which further comprises carrying out the step of removing the gum immediately after the step of applying the gum.

3. The process according to claim 1, which further comprises carrying out the step of removing the gum by rinsing with deionized water.

4. The process according to claim 1, which further comprises carrying out the removing step by removing the gum down to the covering after a time interval being shorter than a time interval until an application of lithographic liquid to the surface.

5. The process according to claim 1, which further comprises carrying out the drying step without an addition of process liquids.

6. The process according to claim 1, which further comprises carrying out the removing step while the gum is still in a liquid state.

* * * * *